United States Patent [19]

Bhagat

[11] 3,954,463

[45] May 4, 1976

[54] METHOD FOR ELECTROSTATIC PRINTING

[75] Inventor: Gopal C. Bhagat, Rochester, N.Y.

[73] Assignee: Xerox Corporation, Stamford, Conn.

[22] Filed: June 24, 1974

[21] Appl. No.: 482,737

Related U.S. Application Data

[60] Continuation of Ser. No. 110,220, Jan. 27, 1971, abandoned, which is a division of Ser. No. 744,183, July 11, 1968, Pat. No. 3,615,128.

[52] U.S. Cl. ..... 96/1.4; 101/426

[51] Int. Cl.[2] ..... G03G 13/14

[58] Field of Search ..... 96/1.4, 1; 117/37; 252/62.1; 101/426

[56] References Cited

UNITED STATES PATENTS

| | | | |
|---|---|---|---|
| 3,271,146 | 9/1966 | Robinson | 96/1.4 |
| 3,368,894 | 2/1968 | Matkan et al. | 96/1.4 |
| 3,531,195 | 9/1970 | Tanaka | 355/4 |
| 3,576,624 | 4/1971 | Matkan | 96/1.3 |

*Primary Examiner*—David Klein
*Assistant Examiner*—John L. Goodrow

[57] ABSTRACT

A method for printing electrostatically including charging a photosensitive plate and exposing it to an optical pattern to form a latent image; placing the plate on a conveyor, developing the latent image and affixing the developed image to the plate to form a xeroprinting master; and charging the master, illuminating the master, developing the master and transferring from the master to a copy sheet the unfused toner to form a copy of the master on the copy sheet.

3 Claims, 1 Drawing Figure

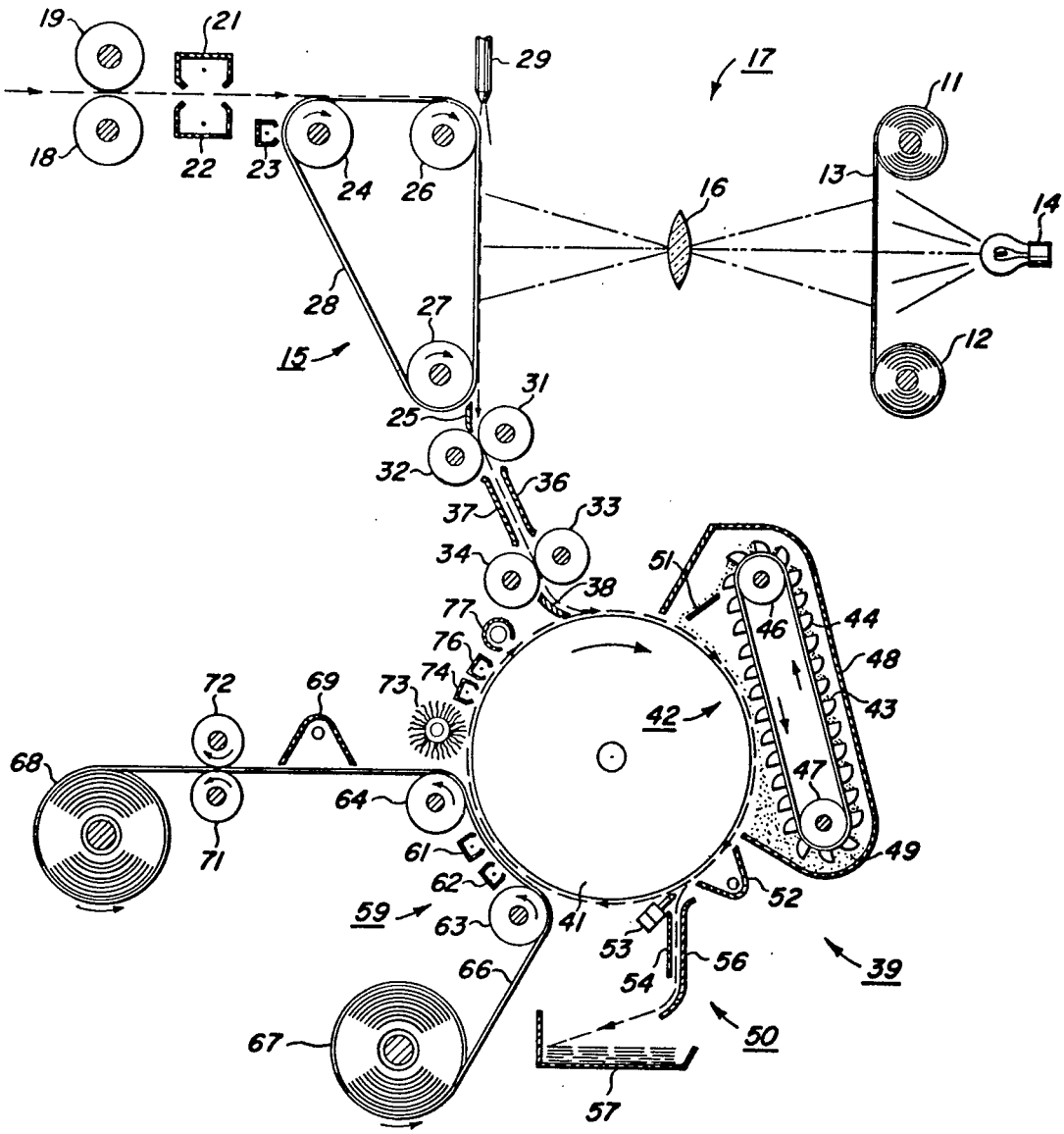
19
21
29
17
11
18
22
23
24
26
16
13
14
28
27
15
12
31
25
32
36
37
33
34
38
51
77
46
44
76
74
48
72
69
73
42
43
68
64
47
71
61
49
62
52
59
63
41
53
56
39
66
54
50
67
57

METHOD FOR ELECTROSTATIC PRINTING

This is a continuation of application Ser. No. 110,220 filed Jan. 27, 1971 now abandoned which in turn is a divisional of Application Ser. No. 744,183 filed July 11, 1968 now U.S. Pat. No. 3,615,128 issued Oct. 26, 1971.

This invention relates in general to electrostatic printing, and, in particular, to forming a xeroprinting master and making copies from it.

This invention utilizes any suitable electrostatic process known, such as xerography, electrography, etc; however, for the purpose of this disclosure the invention will be described in the environment of the xerographic process.

Xerography is essentially a reproduction process which involves the utilization of an electrostatic image created in response to light. To achieve this a layer of photoconductive insulating material is uniformly charged in the dark and then, a light pattern is projected onto it to selectively dissipate the electrostatic charge. The result is to create on or in the photoconductive layer a latent electrostatic charge pattern corresponding to the areas of shadow of the light image projected on the layer. This electrostatic charge pattern is then developed; that is, made visible, by placing a quantity of finely divided, electrostatically-charged developing particles on the surface of the photoconductive material. The powder image may then be affixed to the photoconductive surface, transferred to a suitable image support member such as paper, or otherwise utilized as is well known to those skilled in the xerographic art. For a more detailed description of the xerographic process, reference is had to U.S. Pat. No. 2,297,691 to C. F. Carlson.

The xerographic steps have been utilized as a continuous printing operation in a process called "xeroprinting". In xeroprinting an image consisting of electroscopic marking powder, or toner, is fused onto a support surface having a photoconductive layer thereby creating a xeroprinting master. The photoconductive layer of the master is first uniformly charged, then exposed to light whereby a latent electrostatic charge pattern is formed on the master conforming to the fused toner image on the master. The latent charge pattern is developed with toner which adheres to the fused toner image. The unfused toner then can be transferred to a copy sheet or web thereby creating a copy of the master.

In general, xeroprinting is used to produce a relatively large number of copies of a single pattern and employs electrically insulating or non-conductive toner to form the permanent image on the master. The conductor, usually as a backing layer, is suitably grounded and may be either rigid or flexible and mounted to be continually moving past suitable stations for developing and transferring. Reference is had to U.S. Pat. No. 2,576,047, to Schaffert for a more complete description of the xeroprinting process.

Since images to be reproduced vary in size, any printing plate should have sufficient length to contain the entire pattern being reproduced, as a minimum. Conventional printing apparatus are limited to a fixed standard size of printing plate, the size of which is determined by experience to be economically optimum for the size of image reproduction most frequently encountered. This obviously restricts the use of the apparatus in that plates of longer than standard size cannot easily be accomodated whereas a standard size plate is required for an image consuming less than, and even substantially less than, the entire plate length. In xeroprinting nearly any size image can be accommodated by the xeroprinting master since the length of the master can be determined by the length of the image.

In the process of xeroprinting, as in any electrostatic printing operation or any other continuous printing operation with a large reproduction volume, considerable length and a correspondingly large volume of support member is consumed. Since it is well known in the printing art that the cost of paper represents a substantial portion of the manufacturing cost of printed copy, it is desirable to keep paper costs to a minimum by minimizing waste. Waste is normally comprised of unused portions of support member, and when a printing plate has considerably more length than image thereon, there occurs, with a continuously advancing paper web, a considerable waste or extensive lengths of blank areas between the printed portions being transferred. In the xeroprinting process, since the length of the plate is determined by the length of the information borne on it, this waste is kept at a minimum.

One of the drawbacks with presently known xeroprinting techniques is that there has not been disclosed a complete system whereby the xeroprinting master is made and then reproduction carried out from it continuously in the same machine. The existing apparatus used in xeroprinting merely contemplates the generation of a xeroprinting master as a separate and distinct step from the reproduction step, or its utilization as a conventional printing plate.

Accordingly, it is an object of this invention to improve the method of electrostatic printing so that formation of a master and reproduction therefrom are carried out sequentially as a unified process.

It is a further object of the invention to improve the method of electrostatic printing so that any size master can be made and then copies made from it sequentially and continuously.

The method for electrostatic printing according to this invention involves forming a xeroprinting master as well as making reproductions of the master in one continuous operation. When the xerographic process is used a photosensitive plate is uniformly charged and then exposed to a light pattern whereby a latent electrostatic image is produced on it. Next, the substrate is automatically transported to and placed on a conveyor which carries the master through a developing station where toner is placed on the surface bearing the latent image in imagewise configuration. The master is then carried through a fuser device which permanently fuses the toner to the photosensitive substrate thereby forming a xeroprinting master. Still continuing to be attached to conveyor, the master is brought through charging, exposing, and developing stations, in that order, which form a pattern or unfused toner on the surface of the xeroprinting master, the unfused toner assuming imagewise configuration. The master is then carried through a transfer station where the unfused toner is transferred to a web. The conveyor is cycled once to make a complete xeroprinting master, in addition to once for every copy that is desired to be made from the master. When the desired number of copies have been made from the xeroprinting master, the master is removed from the conveyor and placed in a storage tray.

For a better understanding of the invention as well as other objects and further features thereof, reference is had to the following detailed description of the invention to be used in conjunction with the accompanying drawing which is a schematic illustration showing the path of the plate from the point at which it is initially fed into the apparatus to the point at which it is removed from the drum and placed in the storage tray.

In conventional printing processes the formation of a master is carried as one phase and then, quite independently, the making of copies from the master is carried out in a second phase of the operation. This two phase operation has also been customarily used in electrostatic printing. For instance, in conventional xeroprinting a toner pattern conforming to the image to be reproduced is permanently affixed to the photoconductive insulating surface of the plate thereby producing on the surface of the plate a permanent, electrically-insulating, light-insensitive image pattern which is used as a master. After uniformly charging such a master and then flooding it with light, the electrostatic charge is retained only on the light-insensitive image areas, the photoconductive background being discharged by the light. The master is then carried through the remaining xerographic steps in making copies; that is, the plate is charged, exposed to light, and developed with electrostatically charged marking particles, and the unfused toner particles are transferred in imagewise configuration to a support member or web.

According to the present invention, a plate having a photoconductive layer overlaying a conductive material is uniformly charged and then fed to an exposure station. At the exposure station a light pattern conforming to the pattern to be reproduced is imaged upon the charged photoconductive layer of the substrate. The charge in the light areas of the plate is dissipated while the charge existent in the shadow areas remains substantially unaffected. The plate which now bears a latent electrostatic charge pattern is placed on a drum with the photoconductive layer facing outwardly from the periphery of the drum.

The exposed plate is rigidly secured to the surface of the drum by a vacuum pressure which is imposed on the plate through a multitude of small holes in the periphery of the drum. As the drum turns clockwise, it carries the plate through a developing station where the latent image on the plate is made visible. The drum continues to rotate carrying the plate through a fusing station where the developed image is fused to the plate and made permanent. At this point, a xeroprinting master has been formed from the plate.

The master remains secured to the drum and as the drum continues to turn, the reproduction phase is commenced. The drum carries the master first through a charging station where the master is uniformly charged and then, through an exposure station where all areas of the photoconductive layer on the master which do not have toner fused to it are discharged. The resulting latent electrostatic image on the master is then developed by passing through the developing station. Finally, as the drum continues to rotate, the unfused toner on the master is transferred to a web, completing the first reproduction cycle.

If more than one copy is desired, the master remains on the drum after the first copy is produced and the charging, exposing, developing and transfer steps are carried out again in the same sequence as described immediately above for each additional copy. When the desired number of copies have been made from the master, the master is removed from the drum and guided to a storage tray.

Referring to the FIGURE, the present invention can be divided into two dependent phases, the phase during which the master is formed, and the phase during which reproductions of the master are made. The master is formed from a plate which is capable of retaining an electrostatic charge pattern. The plate can be made of any suitable material; however, in the system shown in the FIGURE, the plate should be flexible so that it can bend to change direction as it is transported to the drum, and so that it can be readily wrapped around the periphery of the drum. A plate that can be used in the apparatus shown in the FIGURE is a photoconductive insulating layer such as zinc oxide which is coated on a support material such as paper which has been rendered conductive. The paper serves at least two purposes; it provides a physical support for the photoconductive insulating layer and it acts as a ground thereby permitting the photoconductive insulating layer to receive an electrostatic charge prior to exposure to a light pattern. For a more detailed description of this type of plate reference is had to U.S. Pat. Nos. 3,121,006 and 3,121,007.

The dotted line through the apparatus shown in FIG. 1 indicates the path of travel of the plate throughout the system while the arrowhead denotes its direction of travel. The photosensitive layer of the plate can be made of any suitable material such as vitreous selenium, known organic photoconductors or particular photoconductive material such as zinc oxide, cadium sulfide or lead oxide, dispersed in insulating binders. The conductive backing can be any suitable material having sufficient electrical conductivity for charging and sensitization of the xerographic recording surface and to accommodate the release of electrical charge upon exposure of the recording surface.

Initially, the plate is fed into the apparatus between rollers 18 and 19 which tend to guide it in the direction of corotrons 21 and 22 and eventually onto movable belt 28. The plate can be any convenient length which is long enough to accommodate the image being reproduced and need not be a standardized length. Hence, if the image to be reproduced were only 2 inches in length rather than the more conventional 11 inches; that is, standard letter length, the resulting xeroprinting master need only be 2 inches long. The two layers of the plate are charged electrostatically to opposite polarities by the corotrons; corotron 21 charges the photoconductive layer of the plate to an appropriate potential while corotron 22 charges the conductive backing layer of the plate in the opposite polarity. It is optional whether the conductive layer is charged at all, but it is preferable to charge it in order that the difference in potential between the charge held on the photoconductive layer and the conductive layer is sufficiently great to afford good development subsequent to exposure. However, if the conductive layer of the plate were kept at ground potential, selective charge dissipation of the photoconductive material would still occur.

After passing through rollers 18 and 19 and corotrons 21 and 22, the plate is placed on belt 28 with its charged photoconductive layer facing out from the belt. Belt 28 is supported and driven by three rollers, 24, 26 and 27. The belt itself can be made of any suitable material which will convey the plate from the area where it is fed between the corotrons mentioned above, through the area where it is exposed to an optical pattern at projector 17, and then, onto drum 41. If the plate is a flexible material, during its travel in the path shown in the FIGURE it can easily turn approximately 90° around roller 26. The material of which belt 28 is made is desirably one which can hold an electrostatic charge, such as a di-electric belt. If such a belt is used, an electrostatic charge can be placed on its outer surface by corotron 23. This electrostatic charge should be of such polarity and intensity that the conveyor becomes attractive to the backing material of the plate causing the plate to adhere to it and assume the path of the conveyor. Corotron 23 can place an electrostatic charge on conveyor 28.

As the plate is carried by belt 28, it turns about roller 26 in order to pass through the optical pattern generated by projector 17. The electrostatic attraction between the plate and the outer surface of the belt is an aid to keeping the plate on the belt while passing around roller 26. In order to further assure that the plate lies flatly on the belt at all times as it changes direction about roller 26, a jet of air created by a source of compressed air (not shown) and nozzle 29 generates an outside coercive force on the plate holding it in firm contact with the belt. The precise configuration of the belt assembly is arbitrary to the invention, and any suitable belt system can be used which allows the plate to be charged, exposed and then, placed on drum 41, in that sequence. The configuration of the belt assembly as shown in the FIGURE is chosen because of its compact design.

After passing through the vicinity of roller 26, the plate is carried adjacent projector 17 by the belt. Projector 17 can be any suitable device which forms an optical image from an original such as a transparency projector, scanning device for scanning opaque and/or translucent originals, etc. In the FIGURE light source 14 illuminates transparency 13. The transparency is fed through the path of light from roll 12, and then, rewound on roll 11 after the plate has been exposed. The optical pattern formed by the transparency and light source passes through lens 16 and onto the photoconductive layer of the plate. The plate can be either stopped for full frame exposure or moving in synchronism with the transparency during exposure. If the plate is not moving during exposure, light source 14 can be flashed to produce quick exposure, as contemplated in the FIGURE. On the other hand, the projector could contain an optical scanning device (not shown) which would permit the plate to continue to move during exposure as long as the speed of the plate and movement of the scanning device are synchronized. The choice of projector device is also arbitrary in the present invention.

After the plate has been exposed, it travels with the belt to the vicinity of roller 27. At this point the plate is separated from the belt and is directed onto drum 41 by an assembly of rollers and guides. The leading edge of the plate is first brought between rollers 31 and 32 and then, through guides 36 and 37. Upon emerging from the guides, the leading edge of the plate passes between rollers 33 and 34 and then, is placed upon drum 41 in such a manner that the exposed surface of the plate faces outwardly from the drum. This is assured by the contour of guide 38 which directs the leading edge of the plate to the right and clockwise onto the drum, as can be seen in the FIGURE.

The charge placed on belt 28 by corotron 23 may tend to keep the plate fastened to the outer surface of the belt after the plate has reached the vicinity of roller 27 and is about to be fed through rollers 21 and 32. Separation of the plate from the belt is enhanced at this point by placing a device adjacent the conveyor which removes or neutralizes the electrostatic charge on the belt put there by corotron 23. Such a device can be attached to roller 27. In addition, mechanical fingers (not shown) can be placed between belt 28 and rollers 31 and 32 which mechanically separate the plate from the belt and guide it between the rollers and onto the drum.

After the plate has been guided onto drum 41, the combined action of any residue electrostatic charge on the conductive layer of the plate plus small holes (not shown) in the drum surface through which a vacuum is imposed on the plate causes the plate to remain on the drum. The plate remains in a stationary position relative to the drum as the drum cycles in the clockwise direction, as shown by the arrow. It is pointed out that drum 41 is merely indicative of a transport device that can be used. The configuration of the drum in serving as a transport device is especially desirable because of its compactness and the relative ease of placing various pieces of apparatus adjacent it in an orderly fashion.

Once the plate is located on the periphery of the drum, various operations are performed on the plate which make it into a xeroprinting master during the first cycle of the drum. As shown in the FIGURE, developing station 42 utilizes conventional cascade development wherein a two-compartment developer mixture comprising insulating toner particles and carrier beads are cascaded over the plate causing the toner particles to be stripped from the carrier beads and adhere to the surface of the photoconductive layer in imagewise configuration. The developer mixture rolls around the drum generally in the direction of travel of the surface of the drum and the stripped carrier beads fall back into the bottom of the developing mechanism to be retoned. The developing station includes housing 48 surrounding conveyor 43. The conveyor is supported and driven by pulleys 46 and 47, and contains buckets 44 which carry the developer material from the bottom of the housing to a point where it is dumped onto the plate as the plate travels adjacent the developing station. Deflector 51 is intended to direct the flow of developer onto the plate at a point where efficient development is assured. Conveyor 43 rotates in the counterclockwise direction in order that the buckets are filled with developer 49 at the bottom of the housing and carry it to the top of the housing where it is dumped onto the plate. For a more complete description of cascade development, see U.S. Pat. No. 2,705,199 to H. E. Clark.

Next, the plate is placed adjacent fuser 52 by the drum which fuses and makes permanent the toner image on the plate and thereby completes the phase of the invention which creates the xeroprinting master. At this point, the plate has been completely transformed into a xeroprinting master and all subsequent operations on it are concerned with making copies from it. The making of copies from the master actually begins when the latent image is reformed on the master; e.g., when the master passes through a reforming station including corotrons 74 and 76 and light source 77. Between the time the master passes fuser 52 and reaches corotrons 74 and 76 during its first cycle, no operation is performed on the master although it passes removal device 50, transfer assembly 59 and cleaning brush 73.

During the image reforming step, a latent electrostatic charge pattern is reformed on the master which conforms to the original latent image formed on the plate by projector 17. The reforming step can be accomplished by any known method such as by employing a charging device in conjunction with a source of illumination as shown in the FIGURE. The charging units, corotrons 74 and 76, uniformly charge the photoconductive layer of the master. Although charging can be accomplished with one charging device, two such devices are used to assure that complete charging occurs, particularly when the drum is rotated at high speeds.

After being charged the master passes beneath light source 77 which discharges those areas of photoconductive surface which are not covered with fused toner. Hence, the charge pattern left on the photoconductive layer after it passes beneath light source 77 is exactly identical to that which was exposed upon the plate by projector 17. This phenomenon is due to the fact that the insulating toner fused to the photoconductive surface of the master shields that area of the photoconductive surface lying beneath it from the radiation generated by light 77 preventing dissipation of the charge in these areas. Therefore, the toned areas of the photoconductive layer retain the charge generated by corotrons 74 and 76 while the charge on all other areas of the photoconductive layer is dissipated. After exposure, drum 41 continues to rotate carrying the master towards developing station 42. At the developing station the latent image on the photoconductive layer is developed in a manner identical to that described above in conjunction with the original development of the plate to make the xeroprinting master. This operation creates a loose, or impermanent, image on the master over the fused toner image already on the master. The drum continues to rotate carrying the master adjacent fuser 52 and removal mechanism 50, and onto the transfer station 59. During the reproduction cycle the fuser and removal mechanism remain inoperative.

Transfer assembly 59 includes reel 67 which feeds web 66 towards the drum and reel 68 which takes up the web after the toner image has been transferred and fused to it. The web fed from reel 67 around roller 63 and between the xeroprinting master bearing the unfused toner and corotrons 61 and 62 which effect the transfer of the unfused toner from the master to the web. The web then passes around roller 64 and under fuser 69 where the toner configuration transferred to the web is fused and made permanent. The web moves between support and guide rollers 71 and 72, and then onto reel 68 where it is stored.

The xeroprinting master which bears the impermanent image comes into contact with the web at the transfer station. Corotrons 61 and 62 place a charge on the web which is of the same polarity as the electrostatic charge pattern on the photoconductive layer of the master and which is opposite in polarity to the charge on the unfused toner particles on the master. The effect of these corotrons is to transfer the unfused toner from the master to the web. After transfer, the xeroprinting master is carried by the drum adjacent cleaning brush 73 where any residue toner not transferred to the web is removed from the master. This cleaning brush is optional in the system, however, it has been found to be helpful in the elimination of excess background in succeeding cycles. The transfer assembly can be adapted to accommodate individual sheets and any other type of support member as well as a continuous web.

After transfer the first reproduction cycle has been completed and if subsequent copies are desired, the drum carries the master through as many cycles as copies desired; in other words, the drum recycles so that the master can be charged, exposed and developed and the unfused toner transferred to the web for each copy desired. When all copies have been made and it is desired that the master be removed from the system in preparation for the making of another master and subsequent reproductions of it, the leading edge of the master is carried to the vicinity of removal mechanism 50 after being cleaned. During the time the master is carried to the removal mechanism, it passes corotrons 74 and 76, light source 77, development station 42 and fuser 51, but, these elements remain inoperative during this time.

Removal mechanism 50 contains puffer 53 which lifts the leading edge of the xeroprinting master from the drum as it approaches the removal area and directs it towards guides 54 and The guides, in turn, direct the leading edge of the master onto storage tray 57 which holds the used xeroprinting masters until they are removed by the operator. For a more detailed description of the operation of the puffer, reference is had to U.S. Pat. No. 3,062,536. At the time that the leading edge of the xeroprinting master is lifted from the drum by puffer 53, the vacuum acting through the drum on the master is released to allow the master the freedom to be directed into the storage tray.

The electro-mechanical devices which control the operations of the various elements in the invention are intended to be any suitable devices which allow the machine to operate as described above. The control devices should permit corotrons 21 and 22 to remain in operation only when a plate is located between them, whereas the motor (not shown) which drives the belt as well as the power source for corotron 23 can be operated continuously as long as the machine is in operation. The projector is activated at a time when a plate is aligned in the path of the optical pattern projected towards belt 28, and if the plate moves while being exposed, the movement of the transparency must be synchronized with the movement of the plate. It is optional whether or not the rotation of the drum be stopped during all times that the machine is in operation for the purpose of simplicity.

The developing station, fusing mechanism 39, and removal mechanism 50, all of which are located around the periphery of the drum, are operated intermittently depending on the position of the master. The developing station is operated only during the time the plate is adjacent it preferably since, otherwise, the drum surface would pick up toner particles and impair contact between the plate and drum surface in succeeding runs. On the other hand, fusing mechanism 39 must remain inoperative except during the time when any plate is carried adjacent it during its first cycle with the drum, i.e., the cycle making it a master. Similarly, removal device 50 must remain inoperative except when the leading edge of the master approaches puffer 53 after its last reproduction cycle is completed.

It is generally immaterial whether transfer station 59, brush 73, corotrons 74 and 76, light source 77 remain operative continuously while the machine is operating or only during the time when they perform a function in the cycle.

Since many of the elements of the invention are required to operate intermittently, it is necessary to have some provision in the control mechanism to start and stop their operation at the correct moment. One method of accomplishing such control is by inserting recognition devices, such as a photoelectric cell, at strategic points along the path of the plate. The devices would recognize the leading edge of the plate as it passed and activate the proper circuit for the next operation. Many other methods could also be used to control the various operations, such as timing belts, trip switches, etc.

In addition to the method outlined above many other modifications and/or additions to this invention will be readily apparent to those skilled in the art upon reading this disclosure, and these are intended to be encompassed within the scope of the invention.

What is claimed is:

1. A continuous method of making reproductions of an original electrostatically with a plate having a uniformly charged photosensitive surface, the steps comprising:

a. orienting the plate in a substantially flat condition;

b. flash exposing the photosensitive surface of the plate while in the flat condition to an optical pattern conforming to the original thereby forming a latent electrostatic image on the plate which conforms to the original;

c. conveying the plate through a developing station adapted to deposit insulating toner on the exposed surface in conformance with the latent image thereon;

d. then, from the developing station conveying the plate directly to a fixing station adapted to permanently affix the toner deposited on the plate;

e. then from the fixing station, conveying the plate bearing the affixed toner directly and without interruption into a circular path of movement through the following stations to reform the image in correspondence to the toner image fixed thereon:

i. a charging station adapted to place a uniform electrostatic charge on the photosensitive surface of the plate, ii. an illuminating station adapted to illuminate the photosensitive surface of the plate thereby dissipating the electrostatic charge in all areas of the plate except in the areas having toner affixed to them, the electrostatic charge in the areas of the plate having toner affixed to them remaining relatively undissipated, and iii. a developing station whereby insulating toner that is deposited on the plate adheres only to the areas of the plate having an undissipated electrostatic charge;

f. then conveying the plate bearing the reformed image to a transfer station to transfer the unfused toner from the surface of the plate to transfer material to make a copy; and g. repeating steps e and f the number of times equal to the number of copies desired.

2. The method according to claim 1 including the step of conveying the plate following said transfer station to a cleaning station to remove leftover unfused toner before starting to reform the image on the plate.

3. The method according to claim 1 including the step of using the same developing station for both developing the permanent image on the plate and for reforming the image.

* * * * *